United States Patent [19]

McDaniel

[11] 4,181,993

[45] Jan. 8, 1980

[54] FLOTATION GARMENT

[76] Inventor: Ralph H. McDaniel, 370 Lime Cir., Henderson, Nev. 89105

[21] Appl. No.: 841,027

[22] Filed: Oct. 11, 1977

[51] Int. Cl.[2] ..... B63C 9/12

[52] U.S. Cl. ..... 9/329; 9/342

[58] Field of Search ..... 9/329, 330, 334, 335, 9/340, 341, 342, 343, 344

[56] References Cited

U.S. PATENT DOCUMENTS

| | | | |
|---|---|---|---|
| 1,167,930 | 1/1916 | Rasmussen | 9/342 |
| 2,389,735 | 11/1945 | Morner | 9/342 |
| 2,608,690 | 9/1952 | Kolb et al. | 9/341 |
| 3,047,889 | 8/1962 | Shaw | 9/329 |
| 3,266,070 | 8/1966 | O'Link | 9/342 |

*Primary Examiner*—Charles E. Frankfort

*Attorney, Agent, or Firm*—Stanley M. Miller

[57] ABSTRACT

A flotation garment employs first and second sheets of a thermoplastic film bonded face to face along a rectilinear grid work of seams forming a spaced array of mutually isolated air cells, so that the garment will not substantially lose its buoyancy when a portion of the cells are punctured. The bonded seams are perforated at selected points to enable adequate ventilation.

4 Claims, 2 Drawing Figures

FIG. 1
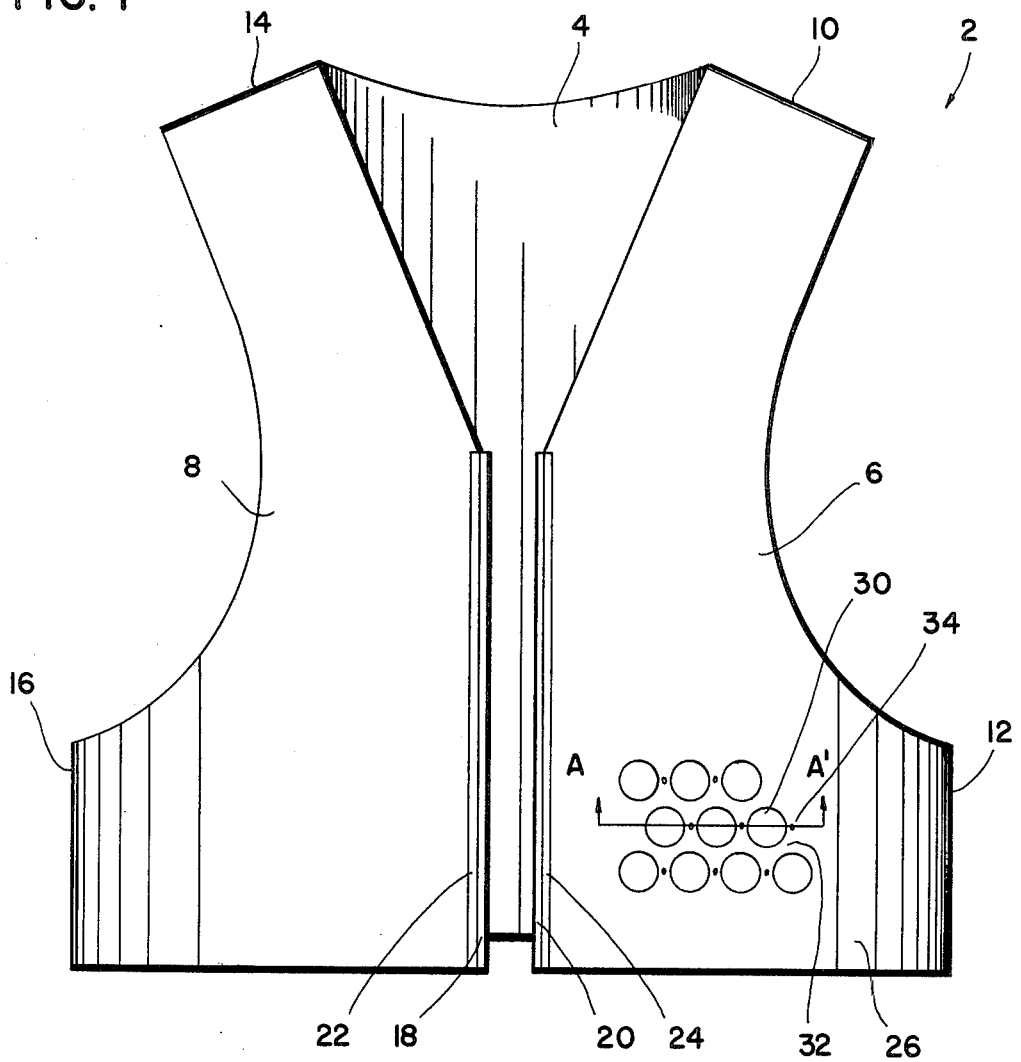
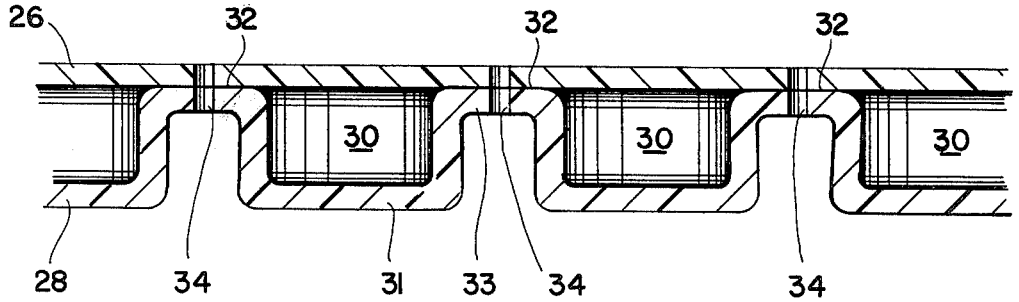
FIG. 2
SEC. A-A'

FLOTATION GARMENT

FIELD OF THE INVENTION

The invention disclosed generally relates to aquatic safety devices and more particularly relates to a flotation garment.

BACKGROUND OF THE INVENTION

The average human body has a specific gravity of somewhat less than one when the lungs are empty of air and of somewhat greater than one when the lungs are filled with air. Thus, while modern practice is to teach swimming with no artificial aid to body buoyancy, various types of life belts and vests have their place as safety factors in water sports. There are four basic types of buoyant life saving devices, the jacket type life preserver, the ring life buoy, buoyant vests, and buoyant cushions. Life preservers are of the jacket type and are heavily padded with buoyant material such as balsa wood, vinyl covered kapok, or fibrous glass. These preservers must be stored in a dry, well ventilated space and require frequent airings and inspections due to their tendancy to deteriorate. Ring life buoys are made of canvas covered cores of cork or balsa wood and may be coated with plastic foam. Because of their bulk, ring buoys are seldom carried on small boats. Buoyant vests have their buoyancy provided by pads of kapok, fibrous glass or light plastic foam packed between the inner and outer layers of the garment. Like the life preserver jacket, the vest must be stored in a dry, well ventilated space to avoid a tendancy to deteriorate. Buoyant cushions are less expensive than other types of life saving gear and are easily stowed and can double as seat cushions, however they are difficult to hang on to in the water and should not be relied upon for the safety of children and non-swimmers. The cushion is not designed to be worn. These prior art types of flotation gear suffer from various combinations of defects of requiring special maintenance to avoid the deterioration and rotting of the flotation material, difficulty in stowage, heavy weight, and inflexibility while being worn. Inflatable life jackets have been developed in the prior art having cavities which can be inflated by compressed gas. A serious defect in this type of life jacket is that the cavities are relatively large so that the accidental puncturing of any one cavity during an emergency will result in the jacket contributing insufficient buoyancy to its wearer.

OBJECTS OF THE INVENTION

It is therefore an object of the invention to provide an improved light weight, flexible, and inexpensive life preserver to be worn as a garment.

It is another object of the invention to provide a flotation garment which will not lose a substantial portion of its buoyancy when accidentally punctured.

It is yet another object of the invention to provide and improved flotation garment which requires little maintenance.

SUMMARY OF THE INVENTION

These and other objects, features and advantages of the invention are provided by the flotation garment invention disclosed herein.

An improved flotation garment is disclosed which employs first and second sheets of a thermoplastic film bonded face to face along a rectilinear grid work of seams forming a spaced array of mutually isolated air cells, so that the garment will not substantially lose its buoyancy when a portion of the cells are punctured. The bonded seams are perforated at selected points to enable adequate ventilation. Preferred materials for the thermoplastic film include polyvinyl chloride and polyethylene terephthalate film which can be heat seal bonded along seams to form the garment and to attach fasteners. The resulting flotation garment is inexpensive, lightweight, flexible, and will not lose a substantial portion of its buoyancy if accidentally punctured.

DESCRIPTION OF THE FIGURES

These and other objects, features, and advantages of the invention will be more fully appreciated with reference to the accompanying figures.

FIG. 1 shows a front view of the flotation garment invention.

FIG. 2 is a cross sectional view along the section line A—A' of FIG. 1, showing in detail, the structure of the thermoplastic film material of the garment which is formed into a spaced array of mutually isolated air cells.

DISCUSSION OF THE PREFERRED EMBODIMENT

The improved flotation garment shown in FIG. 1 is the life vest type. The flotation garment 2 is made up of three basic pieces, the back portion 4, the left front portion 6, and the right front portion 8. The back portion 4 is joined to the left front portion 6 along the seams 10 and 12. The back portion 4 is joined to the right front portion 8 at the seams 14 and 16. A fastener such as a zipper is mounted on the garment with the right half 18 of the zipper being joined along the seam 22 to the right front portion 8 and the left half 20 of the zipper being joined along the seam 24 to the left front portion 6.

The flotation material of which the flotation garment 2 is composed as shown in greater detail in FIG. 2 which is a cross sectional veiw along the section line A—A' of the flotation garment of FIG. 1. The flotation garment material is composed of a first flat sheet of thermoplastic material 26 which is heat sealed to a second, cavity forming sheet of thermoplastic material 28, joined along the heat sealed seams 32, forming a rectilinear grid work of seams separating a spaced array of mutually isolated air cells 30.

The thermoplastic films 26 and 28 may be composed of a polyolefin film such as polyethylene or polypropylene, a polystyrene film, polyvinyl chloride film or a polyester film. The two films can be joined by heat sealing or with adhesive resins.

The preferred materials for the thermoplastic films 26 and 28 are polyvinyl chloride film or polyethylene terephthalate polyester film known by its trade name of Mylar.

Plasticized polyvinyl chloride film employs a primary plasticizer such as a phthalate. Sheets of such plasticized polyvinyl chloride have an elastic modulus (Young's) (kgf/mm$^2$) of 0.28–1.90 (Stress at 100% elongation) and an elastic recovery of 100% from a 1% extension and 95% from a 2% extension. It has been discovered that sheets of such plasticized polyvinyl chloride having a wall thickness of approximately 0.020 inches will withstand a range of water pressures of from zero to ten or more pounds per square inch without exceeding the elastic limit of the material.

Polyvinyl chloride, being a thermoplastic, has a processing temperature of 150°-200° C. The sheet 28 is formed with cavity wall portions 31 and seam portions 33 by placing the sheets 28 over a vacuum forming table having an array of holes which may be circular, square, rectangular or octagonal in shape. By applying a vacuum through these holes in the conventional manner, a hollow cup shaped wall 31 is formed separated by lip regions 33 so as to form cylindrical side walls which may be slightly tapered frusto-conical side walls in the film 28. Other forming techniques can include conventional pressure forming or die pressing. After the hollow cup shaped cavities 30 are formed in the film layer 28, the flat film layer 26 is placed over the film layer 28 in contact with the seam portion 33 thereof. Thermal sealing of the polyvinyl chloride film layers 26 and 28 bonds these layers along the seams 32. This method involves a press with at least one moving platen bar. Bars are heated by low voltage, heavy electric current. Heat is applied to the outer surface of the film 26 along the seams 32 and must travel through the film material 26 to the interface of the films 26 and 28 along the seams 32 to make the weld. A variation of this process, similar to high energy induction bonding, involves putting a metal wire or other insert between the two sheets 26 and 28 to be sealed to make the heating step more efficient. The preferred diameter for the air cells 30 is approximately $\frac{7}{8}$ inch with a cell depth between wall 31 and film 26 of approximately $\frac{5}{8}$ inch. The preferred width of the seam 32 between adjacent cells 30 is approximately $\frac{1}{4}$ inch. The preferred diameter for the ventilation holes 34 is approximately $\frac{1}{8}$ inch. These dimensions result in a preferred population density for the air cells 30 of approximately 144 per square foot.

The resulting flotation material shown in cross section in FIG. 2, is light weight, flexible, inexpensive, and may be cut to size to form the back portion 4, and side portions 6 and 8 for the flotation garment shown in FIG. 1. The edges of the back portion 4 and side portions 6 and 8 which are to be joined at the seams 10, 12, 14 and 16 may be united under heat and pressure, rupturing the air sacks along these seams and fusing the plastic material to a water-tight weld. Arm holes separate seams 10-12 and 14-16.

An optional feature that may be included in the flotation material shown in cross section of FIG. 2, is the inclusion of ventilation holes 34 at selected sites along the seam 32 to enable air to pass from the ambient to the wearer's skin to aid in the ventilation thereof.

The light weight, waterproof, resilient flotation garment which results has the unique advantage of not losing a substantial portion of its buoyancy if a few of the air cells 30 are ruptured during an emergency.

The other preferred material for use as the thermoplastic film 26 and 28 is the polyester polyethylene terephthalate, better known by its trade name of Mylar. Polyethylene terephthalate is a linear polymer which forms a tough, high gloss, biaxially-oriented, unsupported film. It has a high softening temperature and can be thermally set to shape and is relatively resistant to light and is little affected by moisture. Polyethylene terephthalate films are relatively unaffected by hydrocarbons and most common organic liquids, including esters and dry cleaning solvents and by formic, acetic, phosphoric and hydrofluoric acids. It is also resistant to bleaching solutions, reducing agents and mild alkalis and to moderate exposure to mineral acids. Polyethylene terephthalate is a thermoplastic which melts at 250° C. Its films are flexible to below minus 70° C. and are serviceable up to 150° C. Polyethylene terephthalate films soften and can be heat sealed at 230°-240° C. Its elastic Young's modulus is approximately 350 ($kgf/mm^2$) and its wet strength is practically the same as its air dry strength. The film will withstand exterior weathering quite well and is unaffected by bacteria, fungi or insects.

The formation of the flotation material shown in cross section in FIG. 2 may be carried out for polyethylene terrephthalate films in the same manner as was described above for polyvinyl chloride films, namely through the use of a vacuum forming technique to form the hollow cup shaped cavities 30 in the film layer 28 followed by the heat sealing technique to bond the flat layer 26 to the layer 28 along the seam 32.

As is seen in the front view of the flotation garment in FIG. 1, a fastener device such as a zipper as disclosed in U.S. Pat. No. 3,143,779, which is composed of a polyester fabric such as polyethylene terephthalate, may be heat sealed or adhesively bonded along the seams 22 and 24 to the front portions 8 and 6, respectively of the flotation garment of FIG. 1. To adhesively seal of polyester zipper fabric to the polyethylene terephthalate material of which the front sections 6 and 8 of the flotation garment 2 are composed, it may be necessary, to obtain a strong bond, to employ a latex cement including an organic isocyanate to join the polyester zipper material to the polyethylene terephthalate material along the seams 22 and 24.

The polyethlene terephthalate flotation material shown in cross section in FIG. 2 may be cut in the pattern shown for the back portion 4, and front portions 6 and 8 in FIG. 1 for the flotation garment 2 and joined at the seams 10, 12, 14 and 16 by means of joining the edges of the sheets under heat and pressure, rupturing the air sacks 30 and fusing the plastic material into a water-tight weld.

The resulting flotation garment is low cost, light in weight, flexible, resistant to bacteria, fungi, or insects, will not deteriorate due to the rotting of the flotation material and most importantly will not lose a substantial portion of its buoyancy if inadvertently punctured during an emergency.

Although a specific embodiment of the invention has been disclosed herein, it will be understood by those of skill in the art that minor changes may be made in the embodiment so disclosed without departing from the spirit and the scope of the invention.

I claim:

1. A flotation vest comprising:

first and second sheets of a thermoplastic material composed of a member selected from the group consisting of a polyolefin film, a polystyrene film, a polyvinyl chloride film, and a polyester film, bonded face to face along a rectilinear grid work of seams forming a spaced array of mutually isolated air cells which are a plurality of vacuum formed, hollow, cup shaped cavities formed in said first thermoplastic sheet and bonded to said second thermoplastic sheet which is relatively flat, along said rectilinear grid work of seams by raising the temperature of said first and second sheets to their softening point, said first and second sheets being cut into a back portion, a right front portion and a left front portion, said back portion being joined to said left front portion along first and second thermally bonded seams forming a left arm hole and said back portion being joined to said right front portion along first and second thermally bonded seams forming a right arm hole, said gridwork seams of said first and second sheets having perforations therethrough for ventilation;

a zipper composed of a polyester thermoplastic material having a left half thermally bonded to said left front portion and a right half thermally bonded to said right front portion for selectively fastening the left front portion to the right front portion, thereby closing the flotation vest about the wearer.

2. The flotation garment of claim 1, wherein said thermoplastic sheets are composed of polyethylene terephthalate.

3. The flotation garment of claim 1, wherein said thermoplastic sheets are composed of polyvinyl chloride which are bonded by raising their temperature along said seams to between 150° and 200° C.

4. The flotation garment of claim 1, wherein said first and second thermoplastic sheets are composed of polyethylene terephthalate, which are bonded by raising the temperature of said seams to between 230° and 240° C.

* * * * *